US006668842B1

(12) United States Patent
Wilke et al.

(10) Patent No.: US 6,668,842 B1
(45) Date of Patent: Dec. 30, 2003

(54) APPARATUS AND METHOD FOR SANITIZING OR WASHING FOOTWEAR

(75) Inventors: Arno C. Wilke, Wauwatosa, WI (US); James E. Carroll, Elm Grove, WI (US); Jeffery S. Jaworski, Pewaukee, WI (US)

(73) Assignee: Bradley Corporation, Menomonee Falls, WI (US)

( * ) Notice: Subject to any disclaimer, the term of this patent is extended or adjusted under 35 U.S.C. 154(b) by 0 days.

(21) Appl. No.: 09/483,429

(22) Filed: Jan. 13, 2000

(51) Int. Cl.[7] ..... B08B 3/02

(52) U.S. Cl. ..... 134/44; 134/56 R; 134/57 R; 134/58 R; 134/113; 134/119

(58) Field of Search ..... 134/56 R, 57 R, 134/58 R, 44, 104.4, 113, 198, 201, 199

(56) References Cited

U.S. PATENT DOCUMENTS

| | | | | |
|---|---|---|---|---|
| 1,596,676 A | | 8/1926 | Manger | |
| 1,662,498 A | | 3/1928 | Gill et al. | |
| 2,602,724 A | | 7/1952 | Batchelor | 21/61 |
| 2,809,406 A | | 10/1957 | Walter | 21/61 |
| 3,475,780 A | | 11/1969 | Hettich et al. | 15/36 |
| 3,849,822 A | | 11/1974 | Ouellette | 15/36 |
| 3,925,830 A | * | 12/1975 | Delaney | |
| 3,973,286 A | | 8/1976 | Logan | 15/21 |
| 4,233,707 A | | 11/1980 | Leblanc | 15/311 |
| 4,425,677 A | | 1/1984 | Cox | 15/104.92 |
| 4,918,779 A | * | 4/1990 | Burns | |
| 4,922,578 A | | 5/1990 | Miettinen | 15/36 |
| 5,025,528 A | | 6/1991 | Burey et al. | 15/302 |
| 5,071,628 A | | 12/1991 | Alazet | 422/292 |
| 5,164,164 A | | 11/1992 | Strickler et al. | 422/292 |
| 5,185,939 A | | 2/1993 | Kimura | 34/105 |
| 5,588,175 A | * | 12/1996 | Zahner | |
| 5,839,144 A | | 11/1998 | Willner | 15/36 |
| 5,964,959 A | * | 10/1999 | Bleth | 13/199 |
| 5,991,967 A | * | 11/1999 | Williams | |
| 6,105,201 A | * | 8/2000 | Min | |

FOREIGN PATENT DOCUMENTS

| | | | | |
|---|---|---|---|---|
| CA | 2060581 | * | 8/1993 | 134/166 R |
| DE | 2645093 | * | 4/1978 | |
| DE | 2659484 | * | 7/1978 | 134/199 |
| DE | 3623080 | * | 1/1988 | |

(List continued on next page.)

OTHER PUBLICATIONS

WO 00/73688 May 2000.*

Bradley Corporation Installation and Maintenance Instructions—Bradley Bootwash BW 2100, Jul., 1999.

Bradley Corporation, Plumbing Fixtures Technical Data for "Ablution Panel Ritual Hand and Foot Washing Fixture," Jul., 1997.

*Primary Examiner*—Frankie L. Stinson
(74) *Attorney, Agent, or Firm*—Foley & Lardner

(57) ABSTRACT

A method and apparatus for dispensing a fluid of mixed disinfectant and water in a spray to footwear of a worker is disclosed. The apparatus includes a housing including a base section, a platform installed within the base section, a fluid dispensing assembly coupled to the housing, and a fluid dispensing system of mixed disinfectant and water including a first valve assembly configured to dispense fluid to the fluid dispensing assembly when a force is applied to the platform so that the spray of the fluid is dispensed onto the footwear. A method of sanitizing the footwear of a worker with a fluid may include the steps of detecting when the worker has stepped onto a platform and dispensing the fluid onto the footwear for at least a predetermined period. A method of sanitizing the footwear of a worker entering or exiting a location in a work or industrial environment may include the steps of positioning an apparatus at the entrance or exit of the location, coupling the apparatus to a supply of a fluid and wherein the apparatus is actuated to provide a flow including the fluid when the worker steps into the apparatus so that the flow including the fluid is dispensed onto the footwear of the worker.

20 Claims, 13 Drawing Sheets

FOREIGN PATENT DOCUMENTS

| | | | | |
|---|---|---|---|---|
| DE | 4133667 | * | 4/1993 | ..... 134/198 |
| DE | 4408079 | * | 6/1995 | |
| EP | 516563 | * | 12/1992 | ..... 134/166 R |
| FR | 2535193 | * | 5/1984 | |
| JP | 9-56660 | * | 3/1977 | |
| JP | 4-357918 | * | 12/1992 | |
| JP | 6-343676 | * | 12/1994 | |
| JP | 9-47422 | * | 2/1997 | |
| NL | 8600100 | * | 8/1987 | ..... 134/198 |

* cited by examiner

FIG. 3
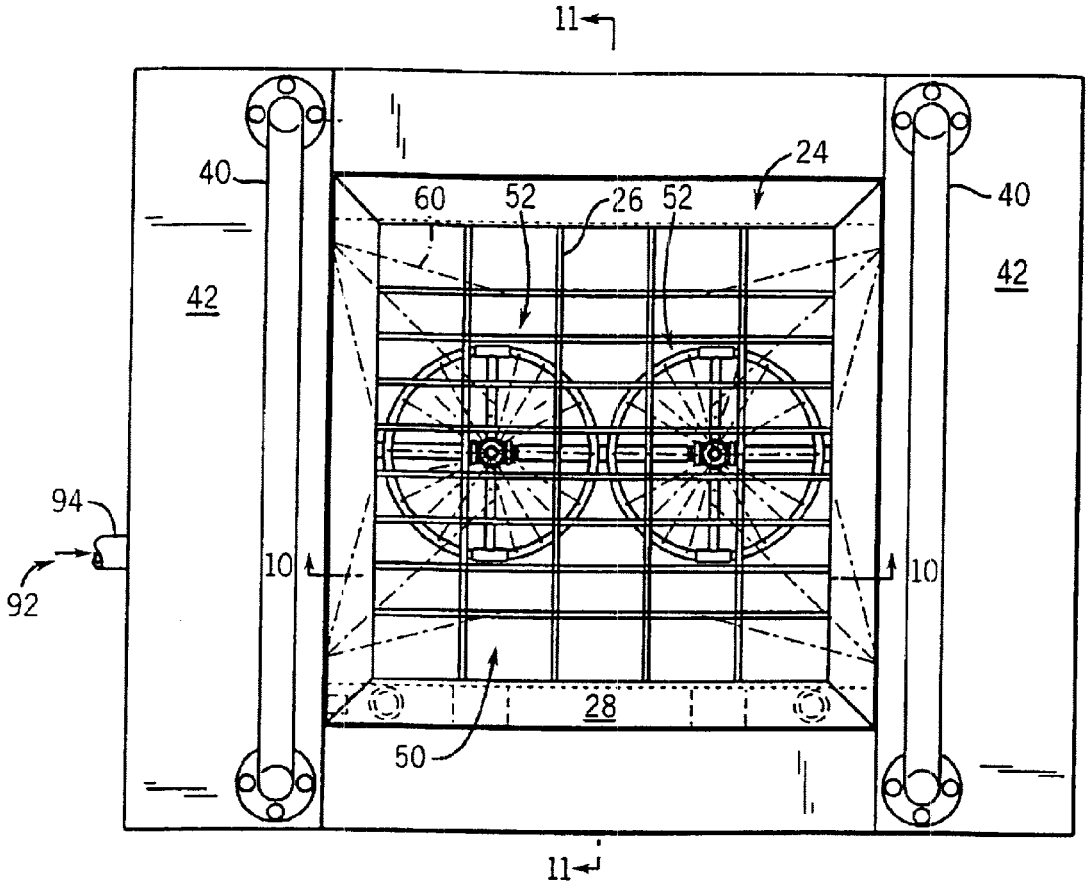
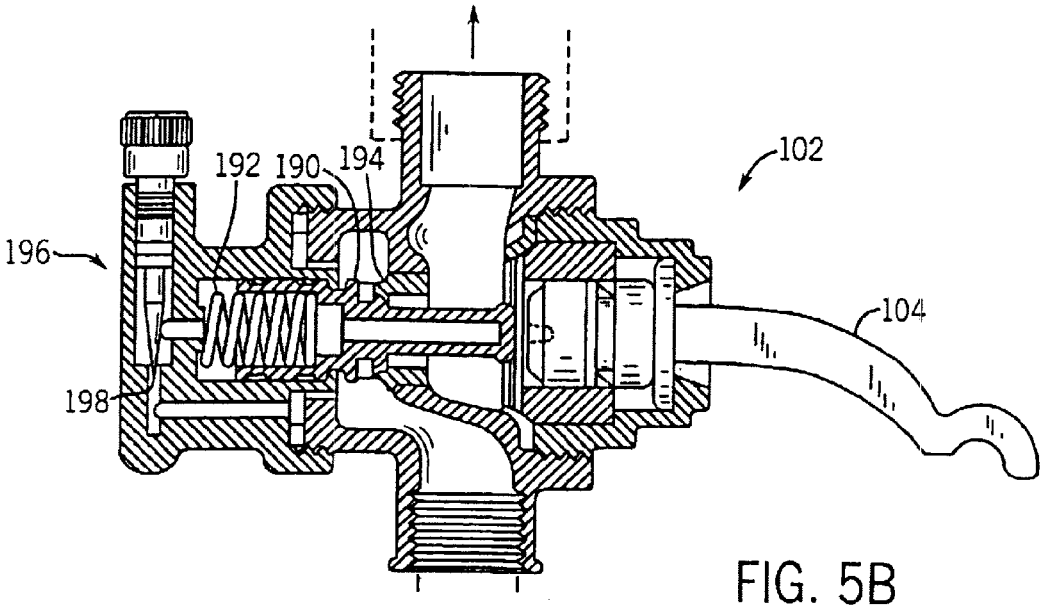
FIG. 5B

FIG. 16
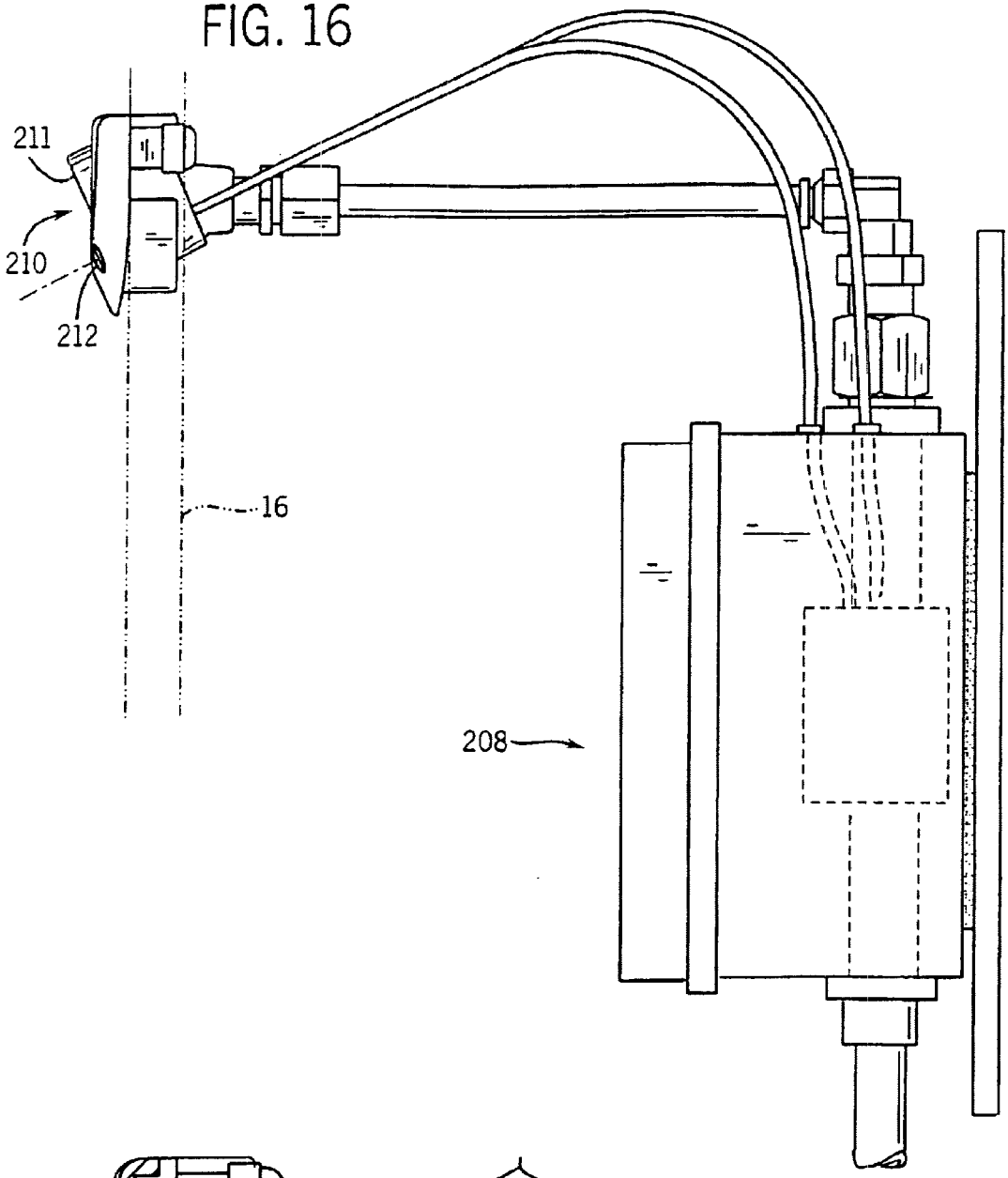
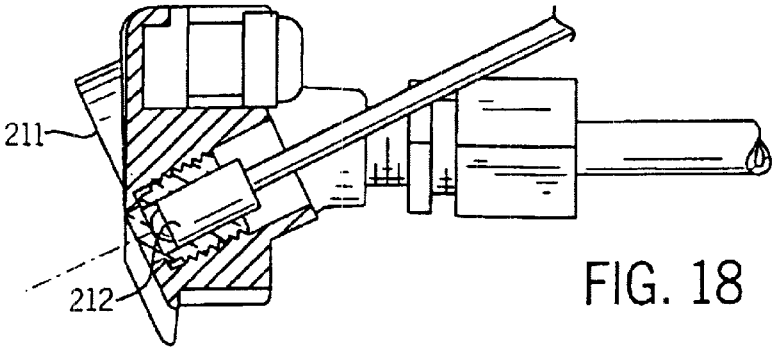
FIG. 18

APPARATUS AND METHOD FOR SANITIZING OR WASHING FOOTWEAR

FIELD OF THE INVENTION

The present invention relates to an apparatus and a method for sanitizing or washing footwear.

BACKGROUND OF THE INVENTION

It is generally known to provide an apparatus for sanitizing footwear of a worker in a work or industrial environment. Such known apparatus for disinfecting shoes require substantial intervention, effort, and interaction by the worker with the device. For example, certain types of such known apparatus include porous material that is partially immersed in the disinfection liquid to serve as a wick to impregnate the porous material with the disinfection liquid, such that the user steps onto the porous material and moves his or her feet to clean and disinfect their shoes. Other types of such known apparatus employ rotating brushes powered from an electrical power source.

However, given the limitations of such generally known apparatus, it would be advantageous to provide for an apparatus and a method for sanitizing footwear that is transportable and can be easily installed in or at a wide variety of locations, or moved to or from a wide variety of locations, in a work or industrial environment. It would also be advantageous to provide for an apparatus that is of a relatively simple and low-cost construction and that can deliver a spray of a fluid mixture including disinfectant solution. It would further be advantageous to provide for an apparatus that facilitates simple "walk-through" operation by the worker. It would be further advantageous to provide for an apparatus and method for sanitizing or washing foreign matter or debris from footwear that allows for convenient adjustment of flow rates and concentration of the disinfectant solution depending upon the needs of a particular application.

It would be desirable for an apparatus and method for sanitizing or washing foreign matter or debris from footwear of a worker in a work or industrial environment to provide one or more of these advantageous features.

SUMMARY OF THE INVENTION

The present invention relates to a transportable apparatus for dispensing a fluid in a spray to footwear of a worker. The apparatus includes a housing including a base section, a platform installed within the base section, a fluid dispensing assembly coupled to the housing, and a fluid dispensing system including a first valve assembly configured to dispense fluid to the fluid dispensing assembly when a force is applied to the platform so that the spray of the fluid is dispensed onto the footwear.

The present invention also relates to a method of sanitizing the footwear of a worker with a fluid, including the steps of detecting when the worker has stepped onto a platform and dispensing the fluid onto the footwear for at least a predetermined period.

The present invention further relates to method of sanitizing the footwear of a worker entering or exiting a location in a work or industrial environment, including the steps of positioning an apparatus at the entrance or exit of the location, coupling the apparatus to a supply of a fluid and wherein the apparatus is actuated to provide a flow including the fluid when the worker steps into the apparatus so that the flow including the fluid is dispensed onto the footwear of the worker.

BRIEF DESCRIPTION OF THE VIEWS OF THE DRAWINGS

FIG. 3 is a top plan view of the apparatus.

FIG. 5B is a sectional elevation view of a flow control element of the apparatus.

FIGS. 13 and 14 are a fragmentary front section elevation view of the apparatus taken along line 14—14 in FIG. 12.

FIG. 16 is a fragmentary side elevation view of the electric activation device.

FIG. 18 is a fragmentary side section view taken along line 18—18 in FIG. 16.

DETAILED DESCRIPTION OF PREFERRED AND ALTERNATIVE EMBODIMENTS

Figure 1:
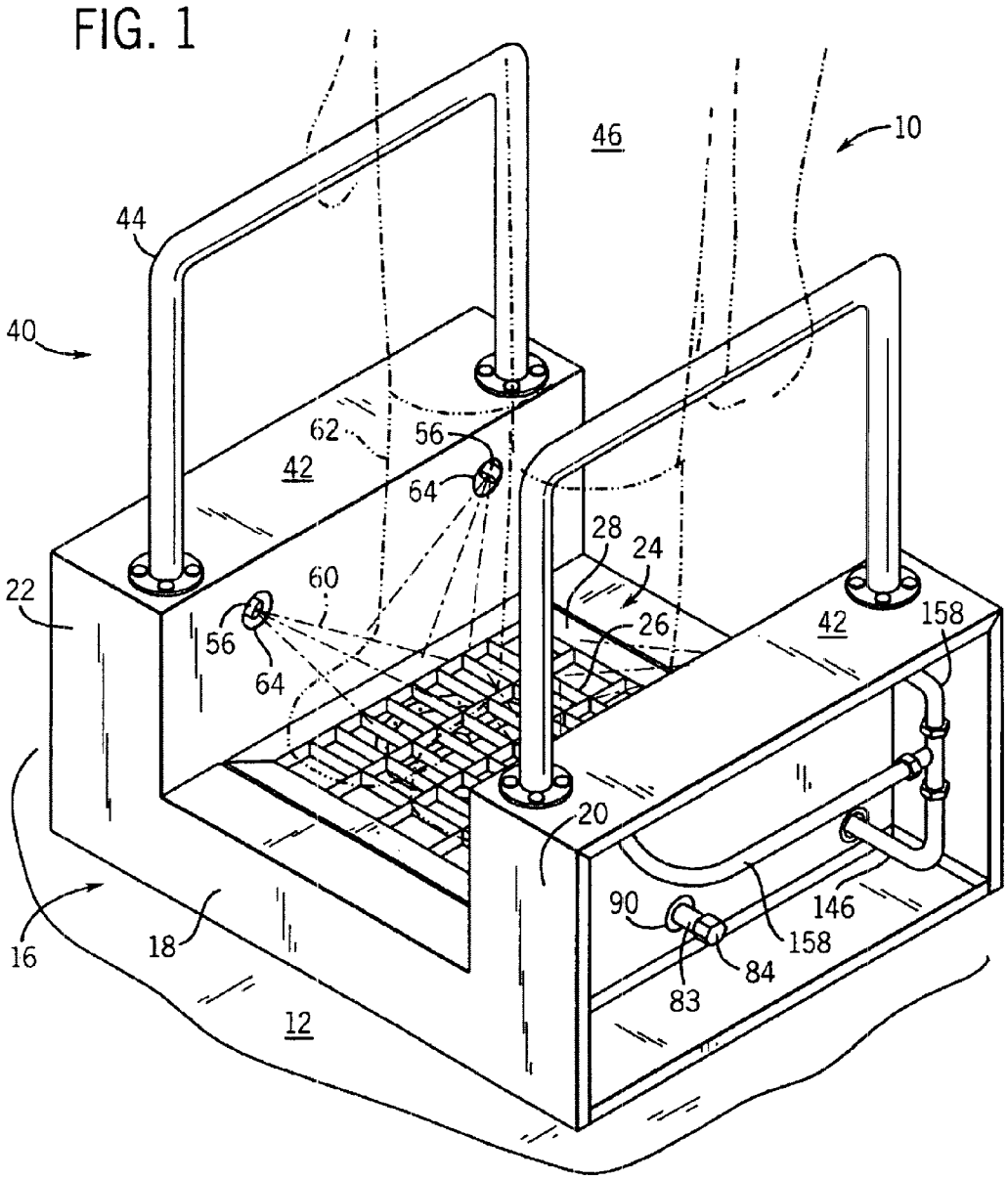
FIG. 1 is a perspective view of the apparatus according to a preferred embodiment.
Figure 2:
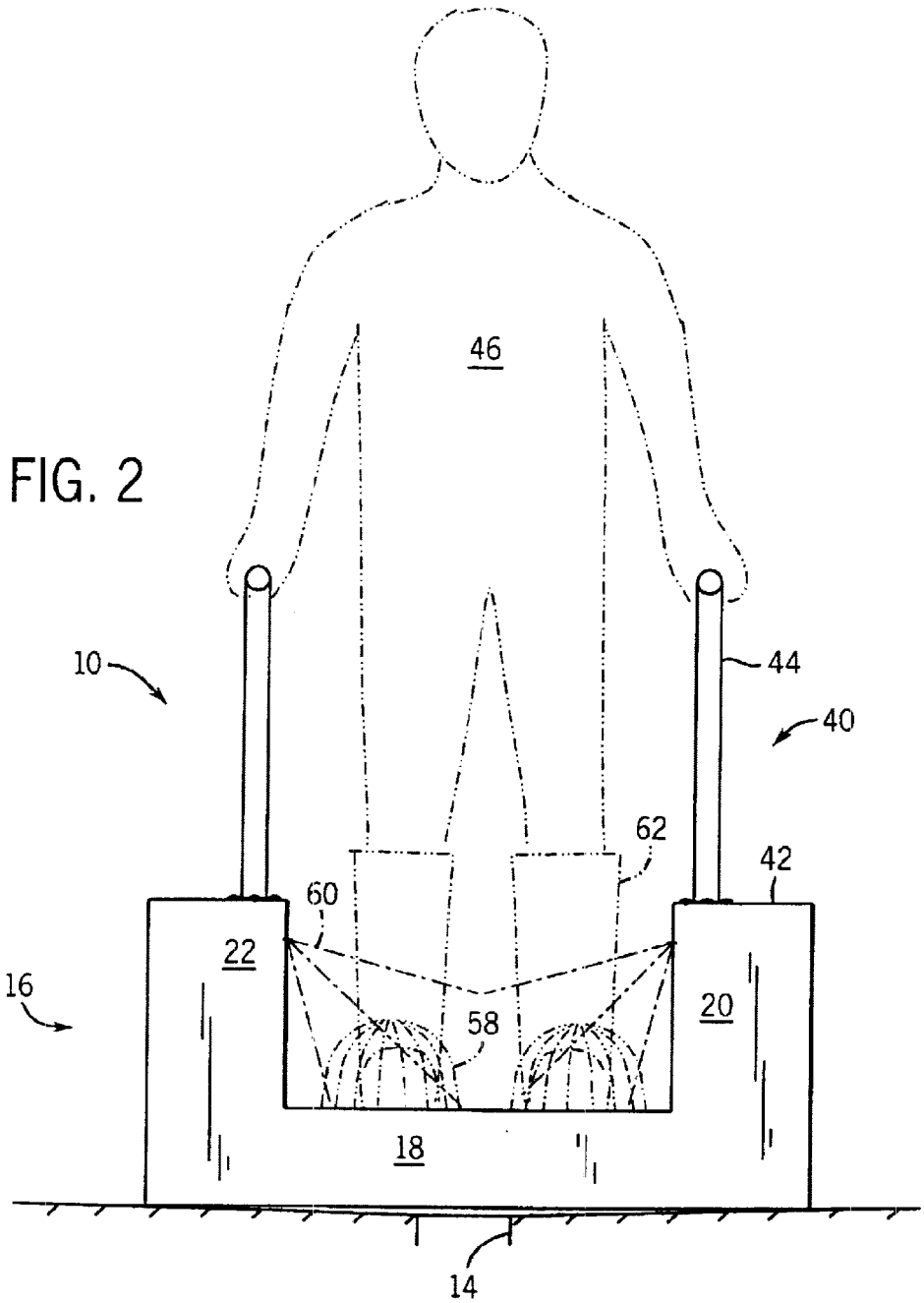
FIG. 2 is a fragmentary front section elevation view of the apparatus.
Figure 6:
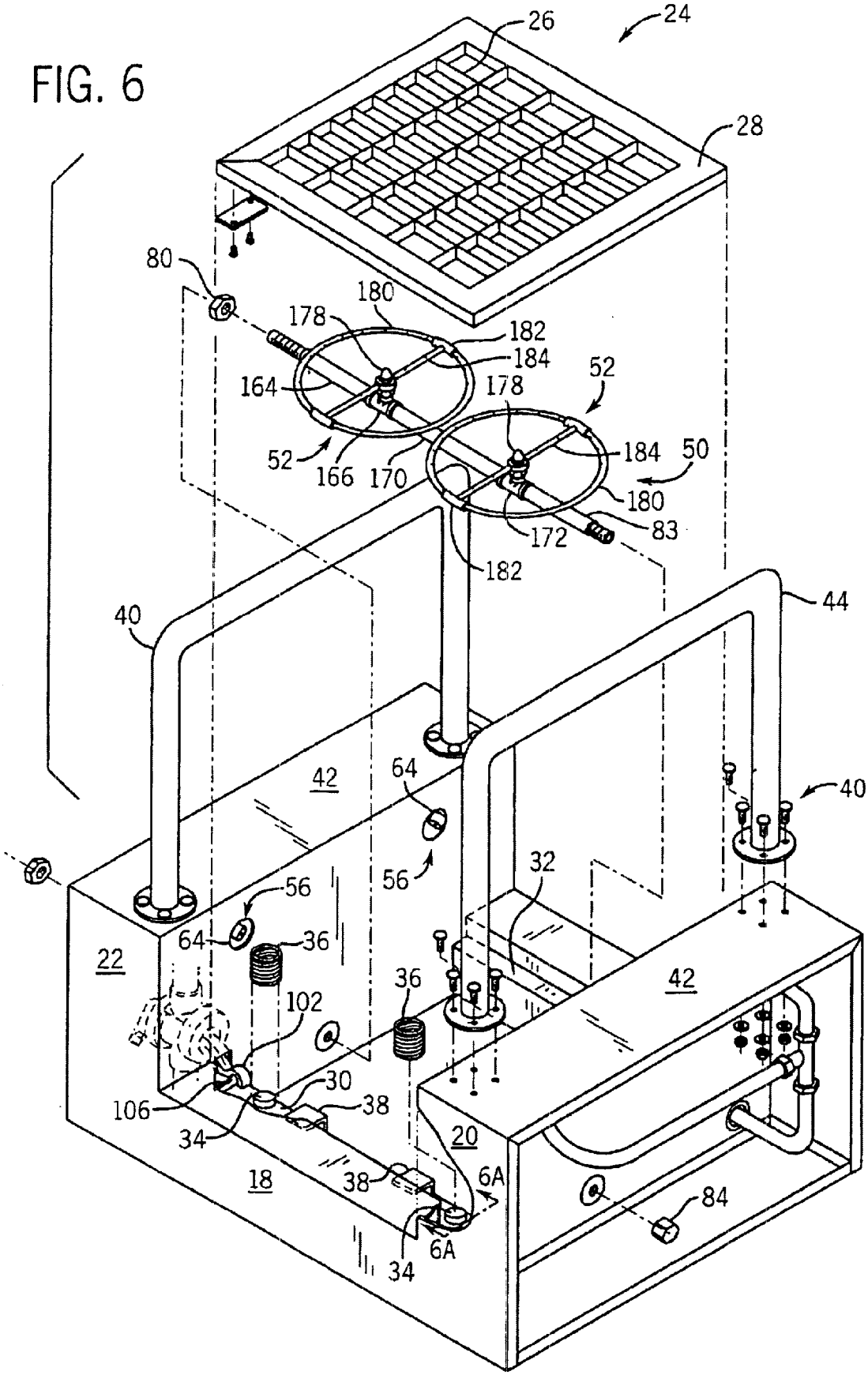
FIG. 6 is an exploded perspective view of the apparatus.

Referring to FIGS. 1 and 6, an apparatus for sanitizing or washing foreign matter or debris from footwear 10 is shown according to a preferred embodiment. According to any preferred embodiment, the apparatus is configured for use in a wide variety of work and industrial environments, such as food processing plants, chemical plants, greenhouses, construction sites, and any other facility where it is desirable for workers to remove or reduce foreign matter (e.g. chemicals, bacteria, by-products, dirt/mud, pollen, contaminants or cross-contaminants, other matter of some kind) from their footwear (e.g. boots such as rubber boots or the like) before entering a facility or when moving from one location to another (such as when exiting a location). According to a preferred embodiment, as shown in FIGS. 1 and 2, the apparatus is configured for "walk-through" use and operation wherein a spray or rinse of fluid (such as water or a mixture of some type including a cleaning or disinfectant solution or the like) is delivered to the footwear of a worker when the worker steps onto the apparatus. Such "walk-through" use minimizes the involvement, effort and interaction with apparatus 10 by the workers, minimize the contact with the workers, and provides for a foreign matter removal or reduction that uses fresh cleaning and disinfectant solution. As shown in FIGS. 1 and 2, apparatus 10 is configured for convenient installation in a work or industrial environment by placement on a surface or floor 12 (which as shown in FIG. 2 provides a drain 14) and connection to a source of fluid (not shown in the FIGURES) such as a facility plumbing system supply water. According to any preferred embodiment, the apparatus is transportable insofar as it may be installed at or relocated to various locations within a work or industrial environment.

Figure 6A:
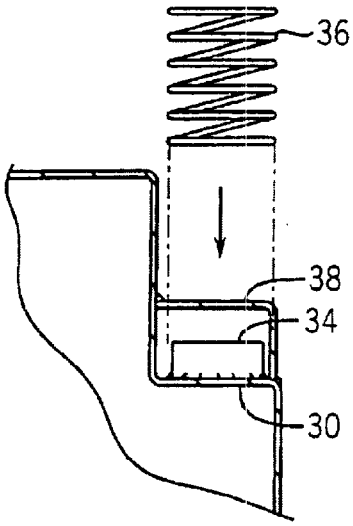
FIG. 6A is a sectional view of the apparatus taken along line 6A—6A in FIG. 6.
Figure 11:
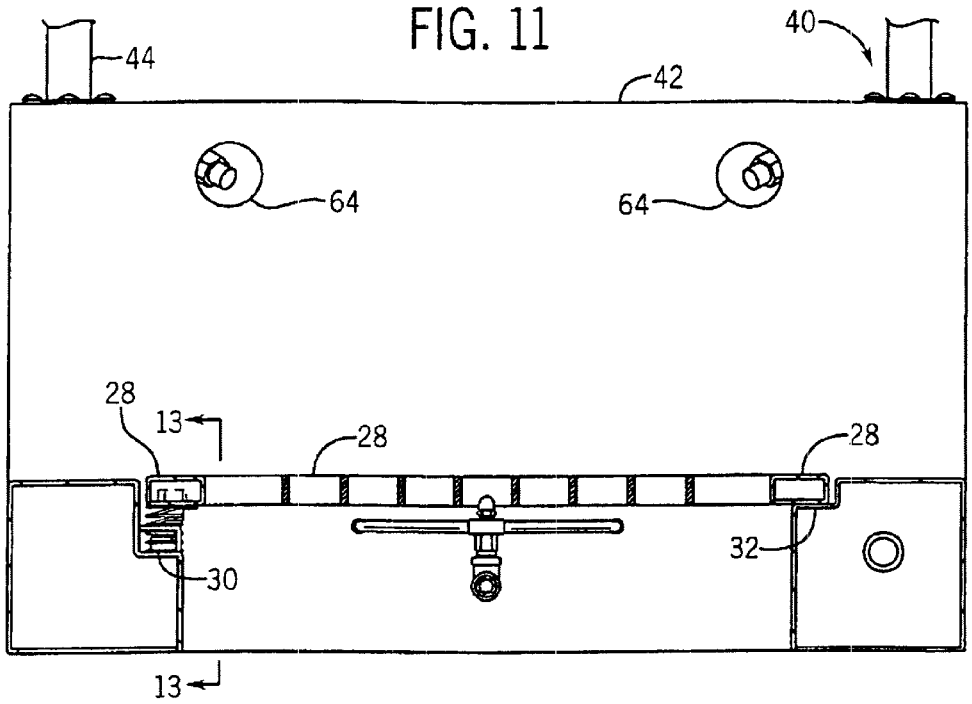
FIGS. 11 and 12 are fragmentary side sectional elevation views of the apparatus.
Figure 12:
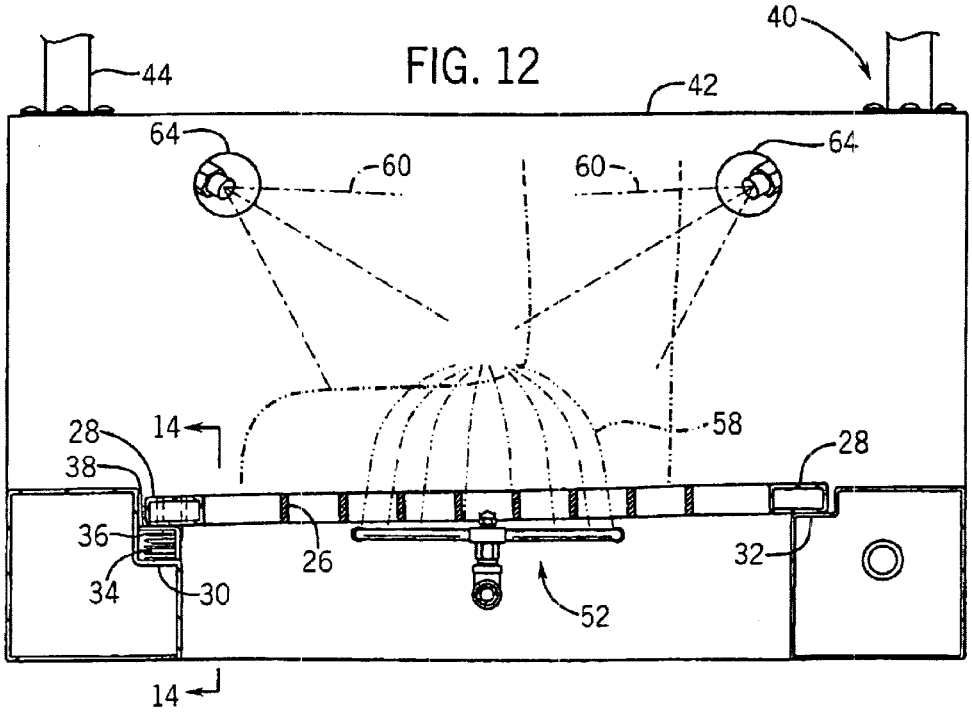
Figure 13:
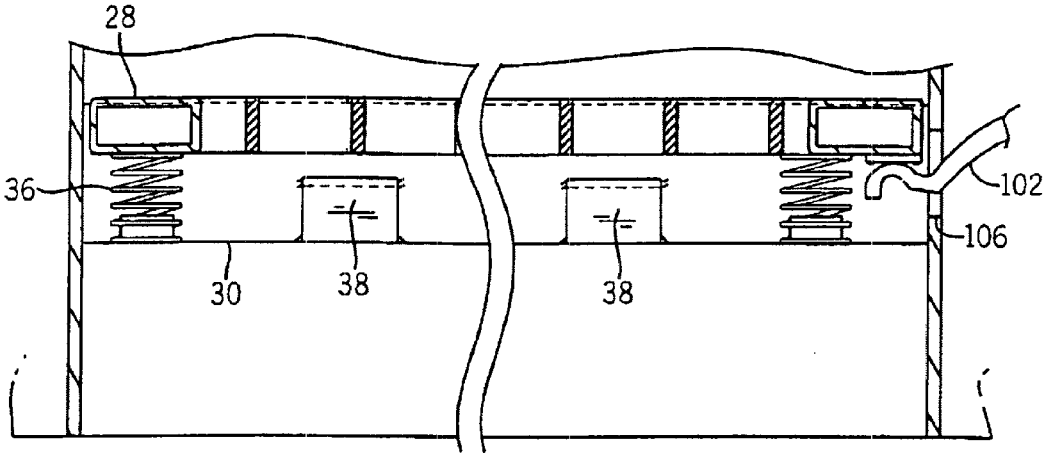
FIG. 13 is a fragmentary front section elevation view of the apparatus taken along line 13—13 in FIG. 11.
Figure 14:
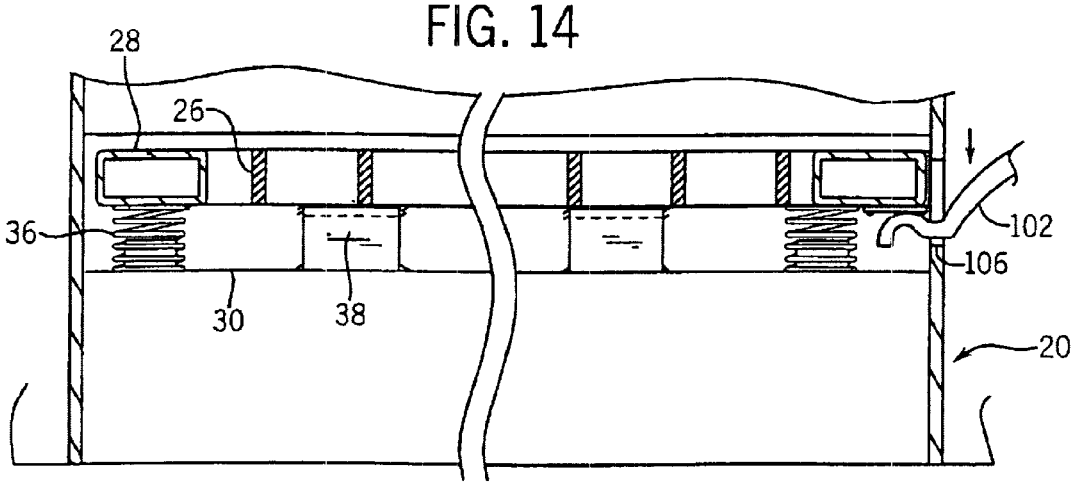
Figure 15:
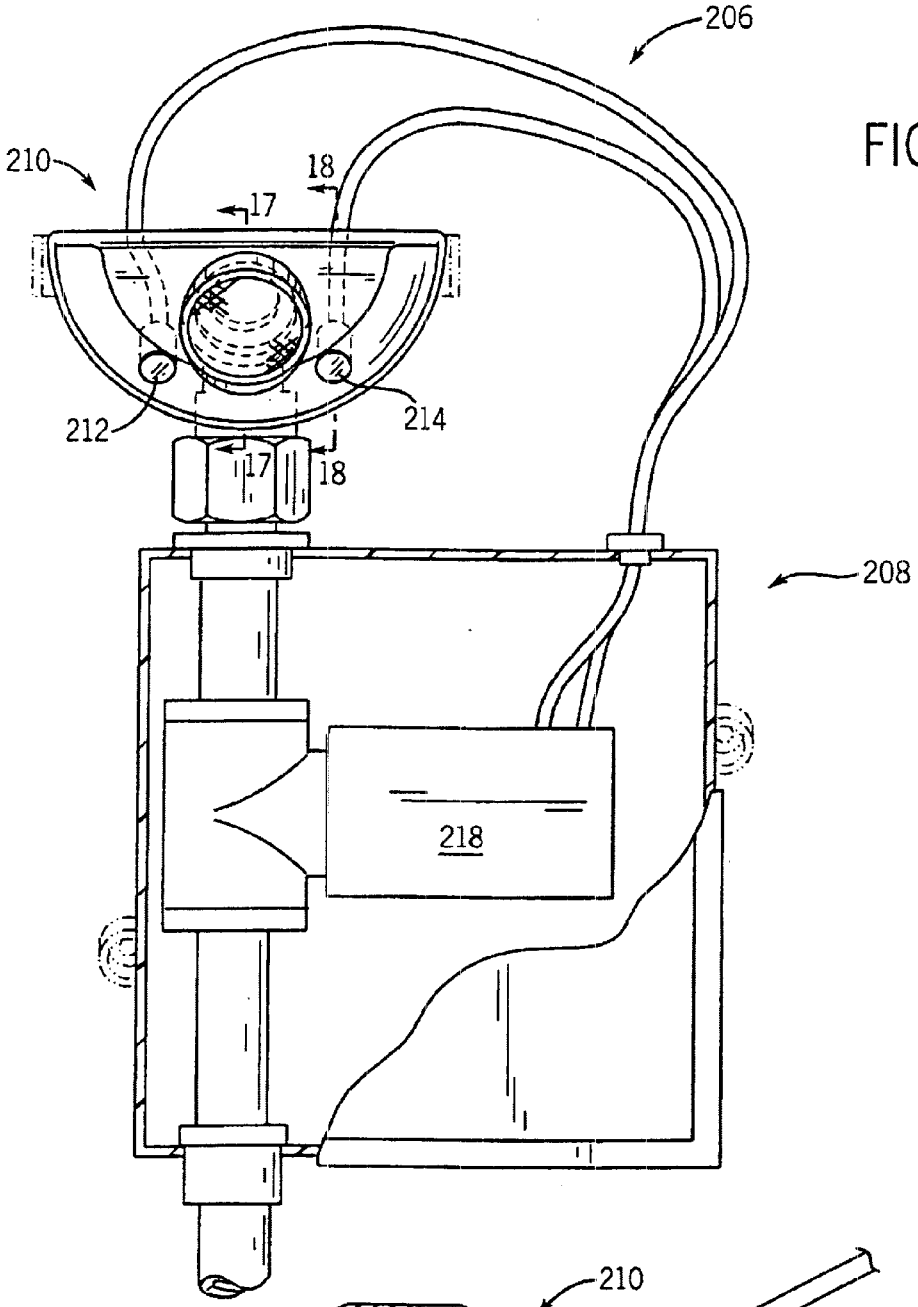
FIG. 15 is a fragmentary front elevation view of the electric activation device.
Figure 17:
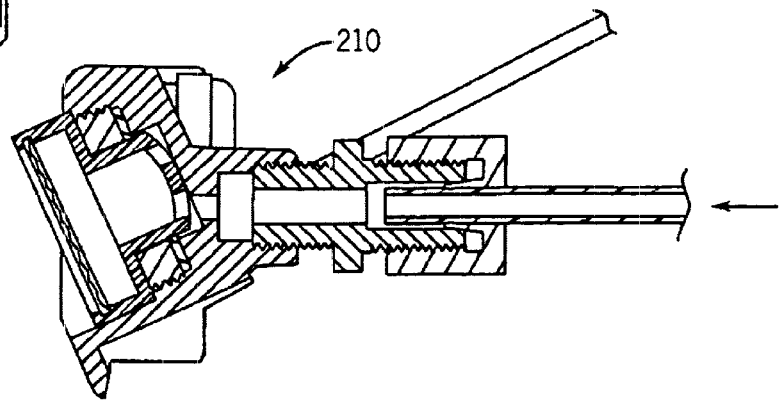
FIG. 17 is a fragmentary side section view taken along line 17—17 in FIG. 16.

Referring to FIG. 6, apparatus 10 includes a housing 16 with a base section 18 and two side sections shown as a right shroud 20 and a left shroud 22. A platform shown as a grate assembly 24 is installed within base section 18 of housing 16. Grate assembly 24 includes a grate (shown as providing and open orthogonal framework) 26 and a frame 28. Base section 18 of housing 16 includes a front ledge 30 and a rear ledge 32 onto which grate assembly 24 is installed (resting on front section and rear section of frame 28). Front ledge 30 of housing 16 includes a set of seats 34 for a set of biasing elements shown as coil springs 36 and a set of stops 38 (shown as brackets). Grate assembly 24 fits within front ledge 30 and rear ledge 32 (see FIG. 6); grate assembly 24 is supported on rear ledge 32 but is supported at front ledge 30 by coil springs 36 (i.e. biasing elements) so as to be maintained in an orientation generally parallel to floor 12 and above stops 38 (see FIGS. 6A, 11 and 13). It should be noted that the conventions "front" and "rear" and "right" and "left" are taken from the perspective of a worker who has stepped onto the grate assembly of the apparatus as it is used in a common application, see FIGS. 1 and 2, although it should be noted that the convention of "front" and "rear" and "right" and "left" may be varied according to alternative embodiments.

Right shroud 20 and left shroud 22 extend above base section 18 of housing 16 of apparatus 10. A grab bar assembly 40 is mounted to an upper surface 42 of each shroud 20 and 22. According to any preferred embodiment, for example as shown in FIG. 2, each grab bar assembly 40 provides a grab bar 44 at a height convenient or suitable for assisting or supporting a worker 46 as the worker steps into and exits from apparatus 10.

Figure 4:
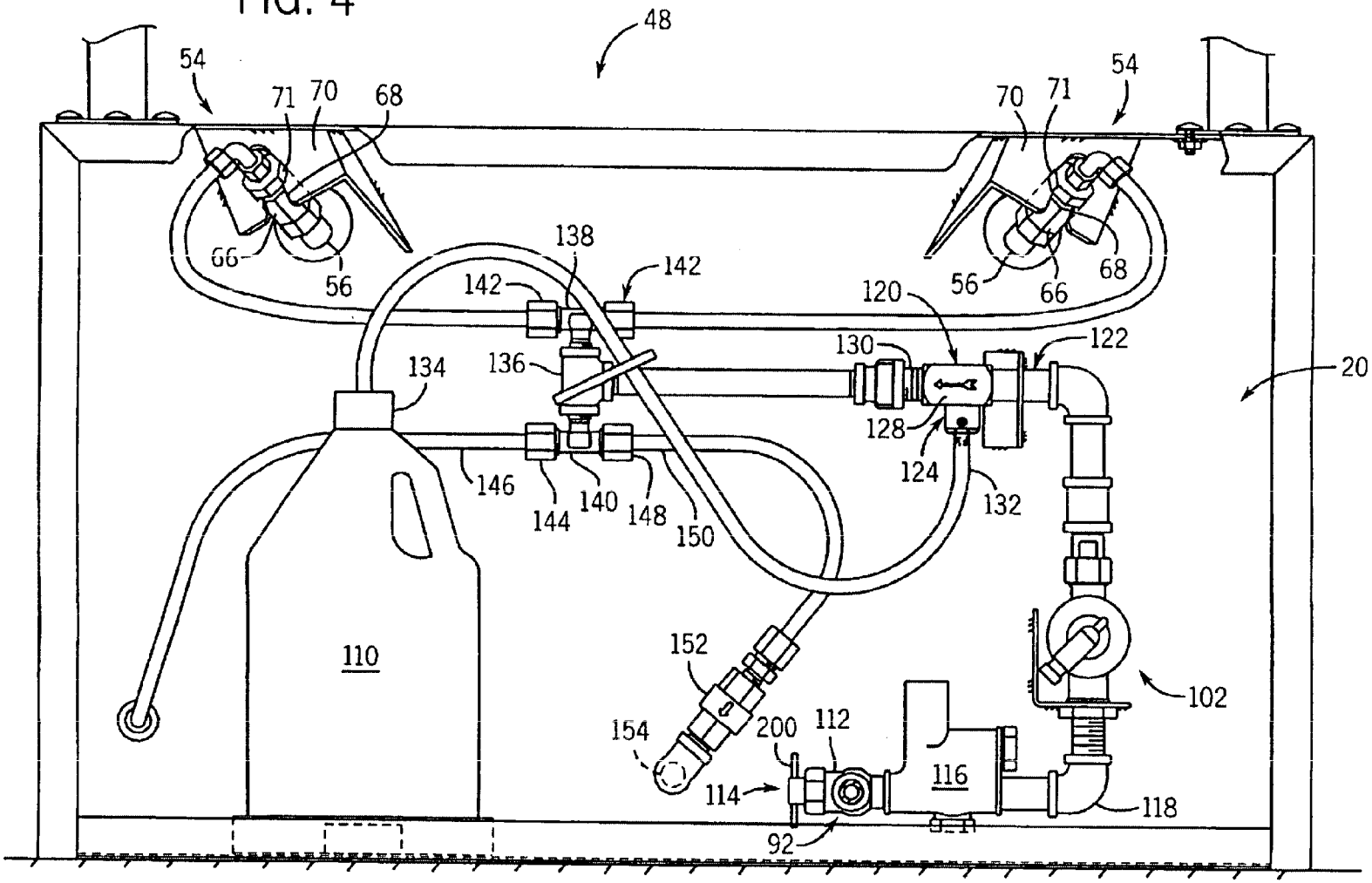
FIG. 4 is a fragmentary left side elevation view of the apparatus.
Figure 7:
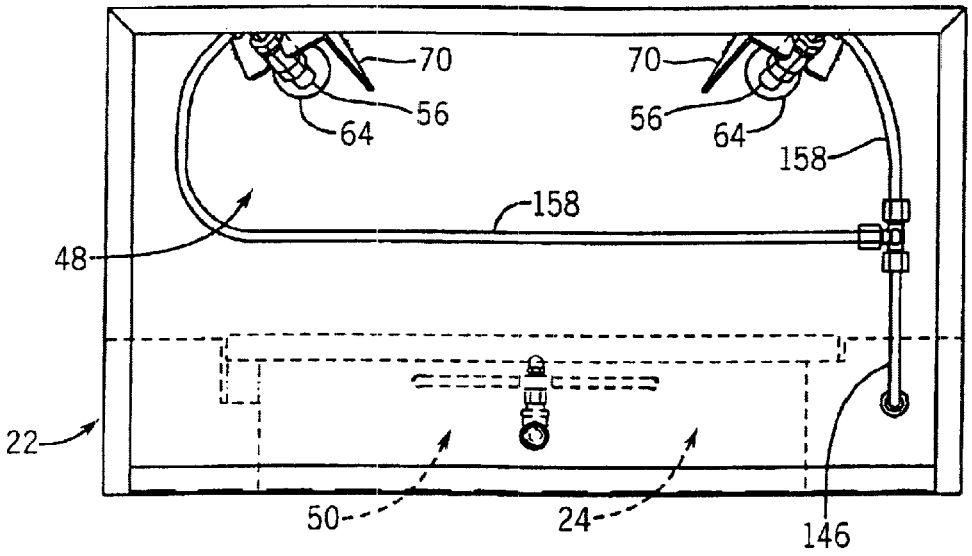
FIG. 7 is a fragmentary right side elevation view of the apparatus.

According to a preferred embodiment, as shown in the FIGURES, apparatus 10 includes a fluid dispensing system 48 (shown in FIGS. 4, 5A, 5B and 7) and two types of fluid dispensing assemblies: a spray head assembly 50 with a set of spray heads shown as spray ring assemblies 52 (see FIGS. 3, 6, 9 and 10) and a set of spray nozzle assemblies 54 with a set of spray nozzles 56 (see FIGS. 4, 7, 11 and 12). Spray head assembly 50 is installed within housing 16 beneath grate assembly 24, and is intended to deliver a fluid spray 58 (see FIG. 2) upward from beneath grate assembly 24. Spray nozzles 56 of spray nozzle assembly 54 are installed within each shroud 20 and 22 of housing 16 and are intended to deliver a fluid spray 60 (see FIGS. 1 and 2) directed inward and downward over footwear 62 of worker 46 who has stepped onto grate assembly 24. According to a preferred embodiment, as shown in FIGS. 4 and 7, each shroud 20 and 22 includes a set of two openings 64 (shown as circular apertures) for spray nozzles 56 of spray nozzle assembly 54. According to any preferred embodiment, the fluid spray from the fluid dispensing assemblies of fluid dispensing system 48 of apparatus 10 is a mixture of supply water and a chemical or disinfectant solution in a predetermined concentration suitable for the particular application. According to alternative embodiments, the fluid dispensing assemblies may be any number of a variety of fluid dispensing systems. According to alternative embodiments, fluid spray 58 delivered from spray head assembly 50 may be any number of a variety of spray patterns and intensities configured to the work or industrial environment, the foreign matter to be reduced or removed, or the footwear worn by the workers.

Figure 8B:
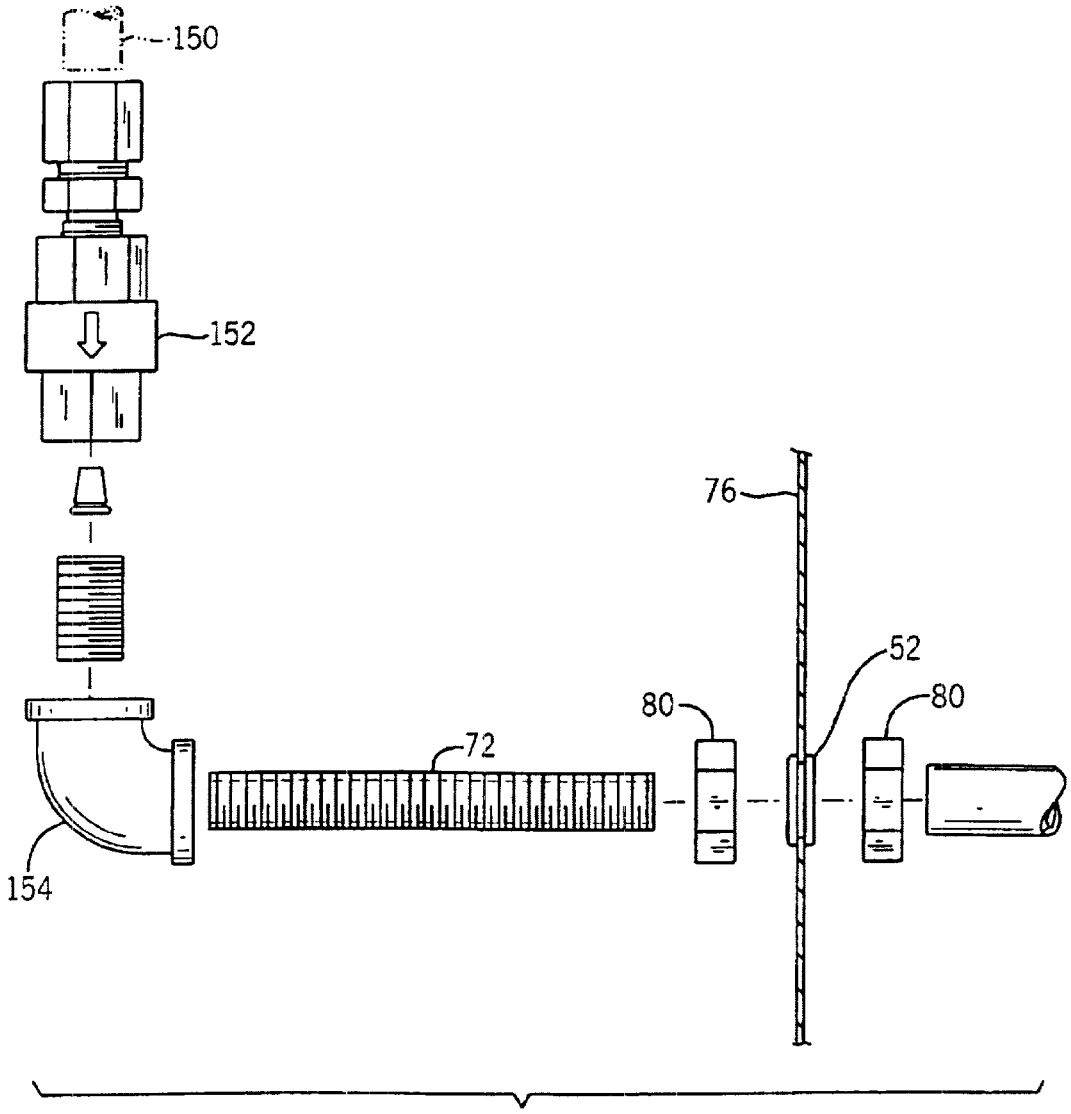
FIGS. 8A and 8B are exploded views of flow control elements of the apparatus.
Figure 8A:
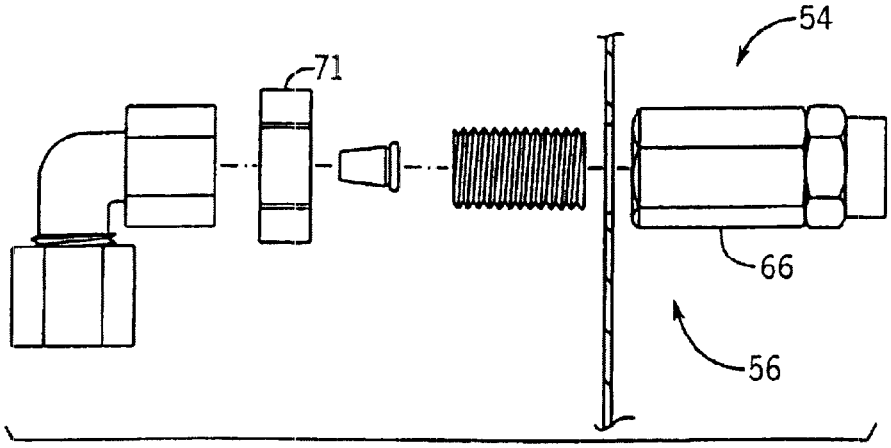
Figures 9, 10:
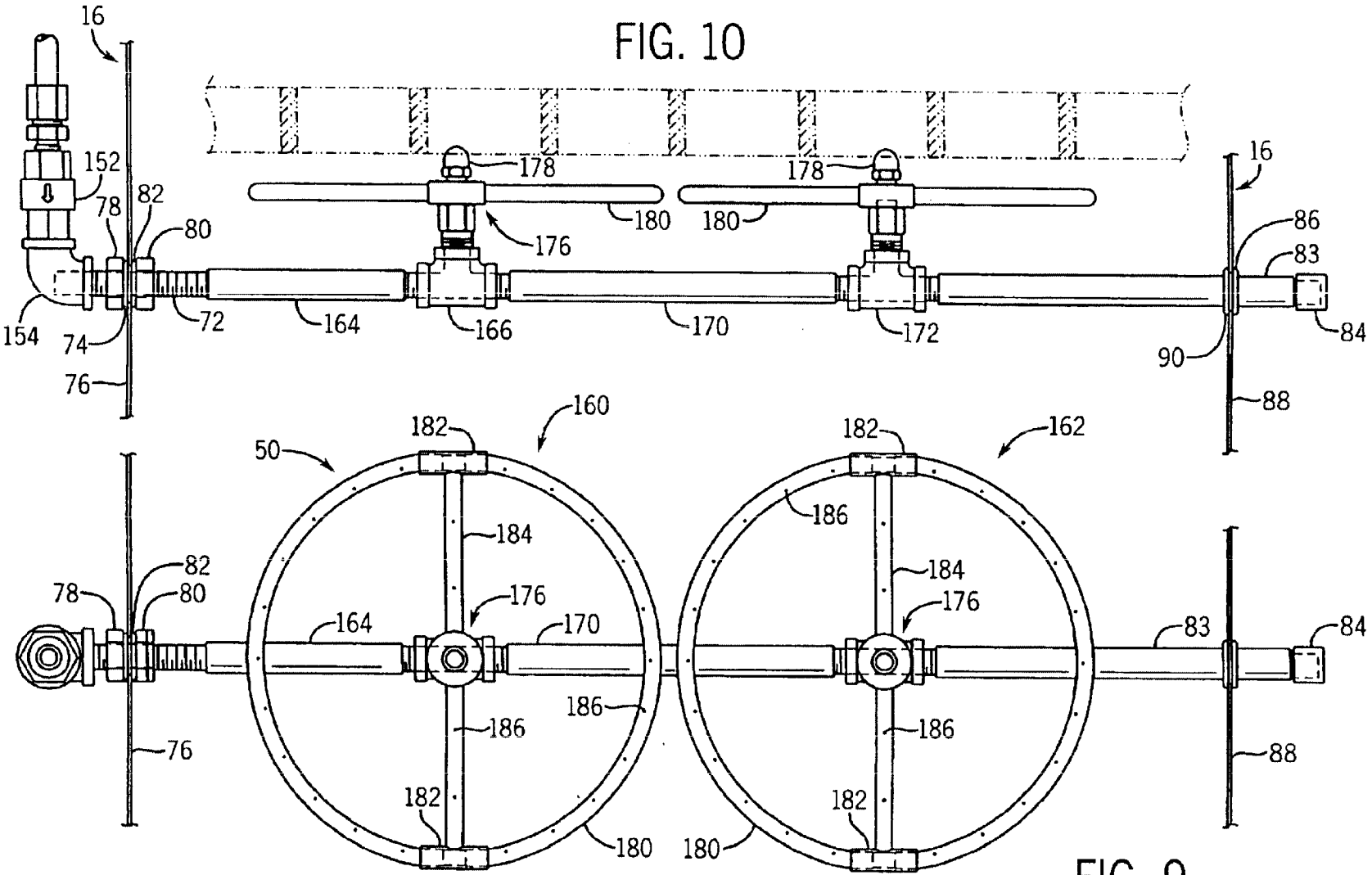
FIG. 9 is a fragmentary top plan view of the apparatus.
FIG. 10 is a fragmentary side elevation view of the apparatus.

As shown in FIGS. 4, 7 and 8A, each spray nozzle 56 of spray nozzle assembly 54 includes a base 66 mounted onto a slot 68 on a bracket 70 attached to right shroud 20 or left shroud 22 of housing 16 (e.g. by welding or the like) with a threaded fastener shown as nut 71 which "clamps" base 66 of nozzle assembly 54 onto bracket 70. As shown in FIGS. 6, 9 and 10, spray head assembly 50 is installed in base section 18 of housing 16 of apparatus 10. Spray head assembly 50 includes an inlet conduit (shown as a threaded pipe section 72) secured within an aperture 74 in wall 76 of housing 16 (e.g. right shroud 20) by two threaded fasteners shown as nuts 78 and 80 on each side of wall 76 separated by a grommet 82 fitted within aperture 74 (see also FIG. 8B); spray head assembly 50 and a terminal conduit (shown as pipe section 83 with an end cap 84) secured within an aperture 86 in wall 88 of housing 16 (e.g. left shroud 22) with a grommet 90 fitted within aperture 86 (see also FIG. 7). According to alternative embodiments, the apparatus may include other types of fluid dispensing assemblies with other types or arrangements of fluid dispensing assemblies (for example, a nozzle that atomizes the fluid) or other arrangements for mounting or installing the fluid dispensing assemblies. According to alternative embodiments, fluid spray 60 delivered from spray nozzle assembly 54 may be any number of a variety of spray patterns and intensities configured to the work or industrial environment, the foreign matter to be reduced or removed, or the footwear worn by the workers.

Figure 2A:
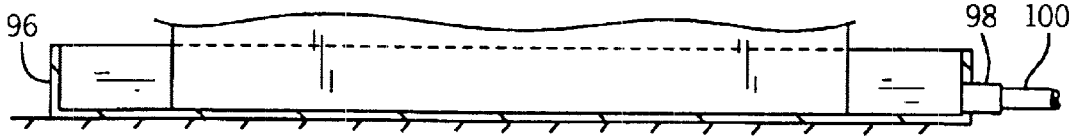
FIG. 2A is a fragmentary front section elevation view of the apparatus according to an alternative embodiment.

As shown in FIGS. 3 and 8A, a primary fluid (such as supply water) is supplied to fluid dispensing system 48 of apparatus 10 at a supply inlet 92 with an inlet conduit (shown as hose 94). According to a preferred embodiment (shown in FIG. 2), apparatus 10 has an open bottom that will allow fluid dispensed from the fluid dispensing assemblies to flow (e.g. by force of gravity) into drain 14 in floor 12. According to an alternative embodiment (shown in FIG. 2A), a drain tray 96 providing a drain outlet 98 with an outlet conduit (shown as a tube 100) can be installed beneath apparatus 10 on floor 12 so that fluid dispensed from the fluid dispensing assemblies is collected and directed to a drain or other outlet (not shown) at a remote or more suitable location.

According to any preferred embodiment, the fluid dispensing system of the apparatus is operated by a mechanism or device that is actuated when a worker steps into the apparatus, for example, onto the grate assembly. As shown in FIGS. 5B and 6, apparatus 10 includes a control valve assembly shown as a "foot valve" assembly 102 associated with grate assembly 24. Foot valve assembly 102 includes an operating lever 104 (see FIG. 5B) that is engaged by grate assembly 24 to operate the fluid dispensing system (see FIGS. 11 through 14). Operating lever 104 of foot valve assembly 102 extends through an aperture 106 in right shroud 20 at front ledge 30 of base section 18 of housing 16 and when grate assembly 24 is installed fits between frame 28 of grate assembly 24 and stops 38 of front ledge 30 (see FIGS. 6, 6A, 13 and 14). A wear plate 108 is installed (by fasteners shown as screws) on the underside of the corresponding corner of frame 28 of grate-assembly 24 to provide an engagement surface for actuating operating lever 104 of foot valve assembly 102 when a downward force is applied to grate assembly 24, for example when a worker 46 steps onto grate assembly 24. According to a particularly preferred embodiment, the wear plate is made from a high density polyethylene (HDPE) material. According to an alternative embodiment, the fluid dispensing system of the apparatus is operated by a manual operation by the worker.

Fluid dispensing system 48 is shown in FIGS. 4 and 7 in relation to right shroud 20 and left shroud 22 of housing 16 of apparatus 10. Referring to FIGS. 4 and SA, right shroud 20 of housing 16 of apparatus 10 is shown according to a preferred embodiment with associated elements of fluid dispensing system 48 and the fluid dispensing assemblies. A container for chemical or disinfectant solution (e.g. in concentrated form) shown as disinfectant bottle 110 is located within right shroud 20. Supply water is provided to fluid dispensing system 48 at supply inlet 92 and to a control valve 112 (e.g. water volume control valve providing an adjustment control 114). From control valve 112, supply water travels to a check valve 116 (shown as a stop-strainer check valve) and then to an elbow fitting 118 and into foot valve assembly 102. When foot valve assembly 102 is actuated (e.g. by operating lever 104) supply water will flow to elbow fitting 118 and into an injection valve 120 (shown as a disinfectant mixing valve). Injection valve 120 provides a primary fluid (e.g. supply water) inlet 122 and a secondary fluid (e.g. disinfectant solution) inlet 124 as well as an internal flow control element 126, a mixing chamber 128 and an outlet 130 (see also FIG. 5C). Disinfectant solution inlet 124 is connected by a conduit (shown as tubing 132) to cap 134 of bottle 110. According to a preferred embodiment (as shown in the FIGURES), flow of supply water into supply water inlet 122 draws disinfectant solution from bottle 110 through disinfectant solution inlet 124 and into mixing chamber 128 of injection valve 120 (e.g. by a "venturi effect"); mixing of supply water and disinfectant solution takes place within mixing chamber 128 of injection valve 120 to create a mixture of disinfectant solution and supply water (i.e. mixture fluid) that can be dispensed through fluid dispensing assemblies 50 and 52. Outlet 130 of injection valve 120 from which mixture fluid is discharged is in communication with mixing chamber 128. Mixture fluid flows into a primary tee fitting 136 where it is then redirected into two secondary tee fittings (shown as upper tee fitting 138 and lower tee fitting 140). Mixture fluid also flows from outlets 142 of upper tee fitting 138 to each spray nozzle 56 of spray nozzle assembly 54 (and each spray nozzle 56) of right shroud 20. Mixture fluid also flows from one outlet 144 of lower tee fitting 140 by a conduit (shown as tubing 146) routed beneath base section 18 of housing 16 to spray nozzle assembly 54 of left shroud 22. Mixture fluid flows from the other outlet 148 of lower tee fitting 140 by a conduit (shown as tubing 150) to a check valve 152 and into an elbow fitting 154 coupled to spray head assembly 50 (see also FIG. 8B). The elements of the fluid dispensing system associated with the right shroud of the apparatus are shown in exploded view in FIG. 5A.

Referring to FIG. 7, left shroud 22 and associated elements of fluid dispensing system 48 are shown (with spray head assembly 50 and grate assembly 24 in phantom lines). Mounting brackets 70 with spray nozzles 56 are shown along with inlet conduit (shown as tubing 158) routed from outlet 144 of lower tee fitting 140 of right shroud 20. Mixture fluid flows from inlet conduit 158 into tee fitting 136 where it is directed to each spray nozzle 56 of spray nozzle assembly 54.

Referring to FIGS. 9 and 10, spray head assembly 50 is shown. Spray head assembly 50 includes a first spray ring assembly 160 and a second spray ring assembly 162. Mixture fluid is provided from check valve 152 (shown in FIG. 8A) through elbow fitting 118 into conduit (including threaded pipe section 72) secured within wall 76 of housing 16. Mixture fluid flows from conduit (shown as pipe section 164) into a tee fitting 166 which redirects mixture fluid both into first spray ring assembly 160 and to a conduit (shown as a pipe section 170) coupled to a tee fitting 172 which redirects mixture fluid both into second spray ring assembly 162 and to a terminal conduit (shown as a pipe section 83 closed by end cap 84) (see also FIG. 7). Each spray ring assembly 160 and 162 includes a center tee fitting 176 and a center cap 178 (shown as an acorn nut) along with a circular conduit formed by two semi-circular conduit sections shown as spray rings 180 and two tee fittings 182; mixture fluid flows from center tee fitting 176 to each circular conduit 180 through a lateral conduit (shown as tube 184) coupled to each of tee fittings 182 so that flow of mixture fluid is provided around each spray ring 180. Spray rings 180 and lateral conduits 184 each have outlet holes 186 which provide for a spray of mixture fluid (e.g. vertically/upward through grate 26 of grate assembly 24).

As shown in FIGS. 2 and 11 through 14, in operation of the fluid dispensing system of apparatus 10, ordinarily there will be no flow from the fluid dispensing assemblies. However, when worker 46 wearing footwear 62 (e.g. boots or the like, or possibly without any footwear) steps onto grate assembly 24, coil springs 36 are compressed and grate assembly 24 is forced downward (i.e. by weight of worker 46) to stops 38 at front ledge 30 of base section 18 of housing 16 which depresses operating lever 104 of foot valve assembly 102. Fluid dispensing system 48 is actuated by foot valve assembly 102 so that a flow of fluid is dispensed from the fluid dispensing assemblies in the form of spray 60 from each spray nozzle 56 of spray nozzle assemblies 54 (e.g. downward/laterally/inwardly onto footwear 62) and spray 58 from each spray ring assembly 52 (i.e. through outlet holes 188) of spray head assembly 50 (e.g. upward through grate 26).

According to a preferred embodiment, as shown in the FIGURES, spray 60 from each spray nozzle 56 is in a generally conical shape and spray 58 from each spray ring 180 is in a generally domed shape. As shown in FIGS. 2 and 3, worker 46 is guided visually by the shape of spray ring assemblies 52 to step onto grate assembly 24 so that footwear 62 of worker 46 is approximately centered over corresponding spray ring 180 of spray head assembly 52 and so that (when operating lever 104 is engaged) spray 60 from spray nozzles 56 of spray nozzle assemblies 54 and spray 58 from spray ring 180 of spray head assembly 50 is directed suitably to rinse foreign matter from footwear 62. According to any preferred embodiment, the fluid dispensing system (which may include one or more spray nozzle assembly and/or one or more spray head assembly), will provide a suitable coverage (i.e. spray pattern and flow rate) of fluid to rinse and/or disinfect the footwear in the particular application. It should be noted that according to any alternative embodiment, the quantity, position, size, shape, spray pattern, orientation, etc. of the fluid dispensing assemblies, and the rate or direction of flow of the fluid, may be customized as required or desired to suit particular parameters for a particular application.

According to any preferred embodiment, the apparatus and method is employed to sanitize (e.g. wash/rinse/ disinfect) the footwear (e.g. boots) worn by workers involved in certain industries (such as food processing) where footwear may be covered with foreign matter or contamination or otherwise may need to be washed.

A method of operation of the apparatus according to a particularly preferred embodiment is as follows: (a) the worker steps onto the grate assembly to activate the foot valve assembly and fluid dispensing assemblies that deliver a continuous spray of mixture fluid; (b) the mixture fluid is mixed from a supply of fresh water and chemical or disinfectant solution by the injection valve; (c) the spray of mixture fluid shuts off when the worker steps off the grate assembly; (d) residual mixture fluid and debris or matter from the footwear of worker drips downwardly through the grate and is discharged through a drain. According to alternative embodiments, the fluid dispensing assemblies may be configured to dispense fresh water only (i.e. without any chemical or disinfectant solution) or discharge residual mixture fluid and debris or matter into a drain tray.

It should be noted that according to any preferred embodiment, each of the elements of the fluid dispensing system of the apparatus may be of a type that is conventional and/or commercially available. According to a particularly preferred embodiment, the foot valve assembly is commercially available (part no. S07-105) from Bradley Corporation of Menomonee Falls, Wisconsin, the injection valve is commercially available (part no. 118-289) from Bradley Corporation, the stop-strainer valve is commercially available (part no. S60-003) from Bradley Corporation, the input check valve is commercially available (part no. 269-1573) from Bradley Corporation. and the volume control valve is commercially available (part no. S02-045) from Bradley Corporation.

Figure 5A:
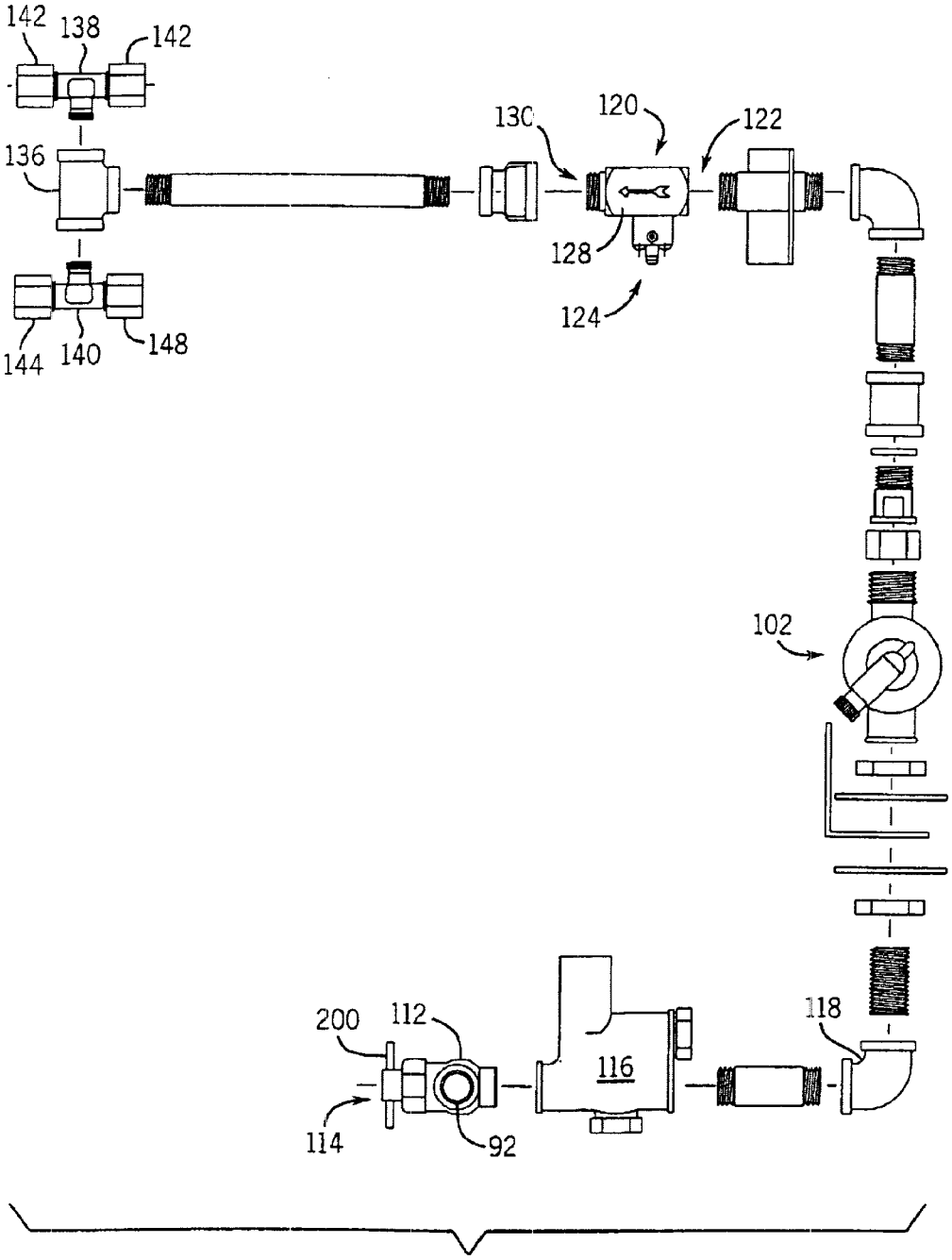
FIG. 5A is a fragmentary exploded view of the fluid dispensing system of the apparatus according to a preferred embodiment.
Figure 5C:
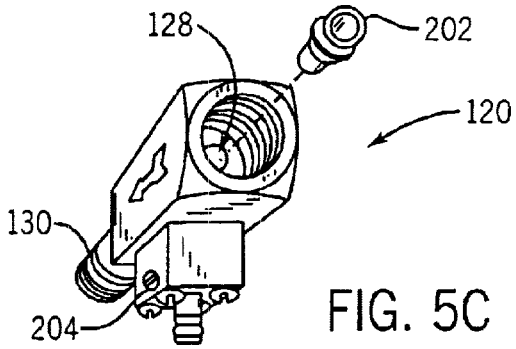
FIG. 5C is a perspective view of a fluid mixing element of the apparatus.

According to a preferred embodiment, foot valve assembly 102 (as shown in FIG. 5B) includes a plunger 190 (coupled to a spring 192) that engages a seat 194; operating lever 104 is coupled to plunger 190 and operates to regulate the flow of fluid through foot valve assembly 102; foot valve assembly 102 is "open" when plunger 190 has been disengaged from seat 194 (i.e. when a force is applied to depress operating lever 104), and is "closed" when plunger 190 is engaged with seat 194 (i.e. when no force is applied to operating lever 104). Foot valve assembly 102 also includes an adjusting needle valve 196 within a needle valve orifice 198 that allows adjustment of the "sensitivity" of operating lever 104 by adjusting the orifice 198 (to prevent water hammer) and therefore the opening and closing rate of foot valve assembly 102. As shown in FIG. 5A, stop-strainer check valve 116 includes a check assembly and a stop assembly, as well as a screen to prevent the introduction of foreign matter from the inlet of the supply water into the fluid dispensing assemblies of the apparatus. Volume control valve 112 includes a handle 200 (shown as a "t-handle) for flow volume adjustment. As shown in FIG. 5C, injection valve 120 includes a water nozzle bushing 202 and an adjustment screw 204 for increasing or decreasing the "injection rate" of disinfectant solution into the supply water. The tube between the disinfectant bottle and the injection valve includes a screen at the inlet to prevent foreign matter from entering the tube and the injection valve. According to a preferred embodiment, the injection rate of the disinfectant solution can be adjusted by the adjustment screw in response operating parameters, such as the total fluid flow rate, spray nozzle pressure and viscosity of the disinfectant solution. (Exemplary operating parameters and information for the apparatus according to a particularly preferred embodiment are published in the Installation and Maintenance Instructions for the Bradley Bootwash BW 2100, No. 215-1321, Rev. B, EN 99-048A, incorporated by reference herein.)

According to a particularly preferred embodiment, the apparatus is made from 14-gauge stainless steel with a bead-blasted finish (and weighs approximately 150 pounds). According to alternative embodiments, the housing may be made of other materials (such as metal or plastic) in various combinations. The apparatus has a width of approximately 41 inches and a length of approximately 33 inches; the grab bars are approximately 29 inches in length, spaced approximately 28 inches apart (on centers) and at a height of 39.75 inches; the optional drain tray is approximately 43 inches in width and approximately 35 inches in length; the grate assembly is located approximately 6 inches above the floor (e.g. the height of the step for the worker onto the apparatus).

According to an alternative embodiment, the fluid dispensing system of the apparatus is operated by an electric activation mechanism or device that actuates a solenoid valve when a worker steps into the apparatus, for example, onto the grate assembly. As shown in FIGS. 14–17, apparatus 10 includes a electric activation device 206 and a solenoid valve module 208. Solenoid valve module 208 is coupled to a sensor assembly 210 that sends a signal to the fluid dispensing system. Sensor assembly 210 includes a spray head 211, a sensor having a sender 212 and a receiver 214 having a detection area above grate assembly 24. Sensor assembly 210 is fitted to an aperture 216 in right shroud 20 and/or left shroud 22 of housing 16. According to the preferred embodiment, a solenoid valve 218 disposed in solenoid valve module 208 receives a signal from the sensor and actuates fluid flow. According to an alternative embodiment, solenoid valve module 208 may shut water flow off after a pre-determined time. According to a particular preferred embodiment, the sensor is an infrared sensor that electronically activates a twenty-four volt solenoid valve using a 24-volt AC, 50/60 Hz power supply. According to alternative embodiments, the sensor may be any number of a variety of commercially sensors (for example, a battery operated infrared sensor). According to alternative embodiments, the electric activation device can be manually operated by actuation of a switch.

According to a particularly preferred embodiment, the apparatus operates with optimum flow rates in a range of from 3 to 5 gallons per minute and provides a spray from the spray head assembly (beneath the grate assembly) at a height of between 2 to 10 inches above the grate assembly (with a preferred inlet water pressure of between 25 and 80 pounds per square inch (psi)); an approximately fifty-pound center load on the grate assembly will activate the apparatus. To protect plastic elements and the worker, water temperature should not exceed 120 degrees F. According to alternative embodiments, by varying the fluid dispensing assemblies, the apparatus can be configured to operate with flow rates as low as one-half gallon per minute or even other ranges of flow rates.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, other valve types or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. An apparatus to sanitize footwear with a water and disinfectant solution, the apparatus comprising:

a housing having a plurality of openings;

a grate coupled to the housing and configured to support a weight of a user;

a valve assembly having a valve, an actuating member operatively coupled to the grate and configured to actuate the valve between an open position and a closed position, and a biasing member disposed between the grate and the housing;

a mixing valve adapted to mix the solution; and a spray assembly coupled to the mixing valve and including a plurality of nozzles directed to the footwear of the user, wherein the weight of the user moves the grate so that the actuating member actuates the valve to the open position and solution is sprayed through the plurality of nozzles substantially upwardly through the grate and substantially horizontally through the openings in the housing.

2. The apparatus of claim 1 further including a supply of water coupled to the valve and a supply of disinfectant coupled to the mixing valve, wherein the supply of water and the supply of disinfectant being located in the housing.

3. The apparatus of claim 1 wherein the biasing member includes at least one spring configured to partially support the grate.

4. The apparatus of claim 1 wherein the spray assembly includes a spray ring located under the grate.

5. The apparatus of claim 1 further including a volume control valve coupled to the mixing valve and configured to adjust the volume of water supplied to the spray assembly.

6. The apparatus of claim 1 further including a mixing valve adjusting screw coupled to the mixing valve and configured to adjust the volume of disinfectant dispensed.

7. The apparatus of claim 1 further including a pair of upwardly extending grab bars connected to the housing.

8. The apparatus of claim 1 further including a tray located under the grate and configured to collect the solution.

9. An apparatus for walk-through sanitizing of footwear with a fluid when a user steps onto the apparatus, the apparatus comprising:

a housing including a base section, a first side section and a second side section, each of the first side section and the second side section extending from the base section and having one or more openings;

a platform located between the first side section and the second side section and configured to support a weight of a user;

a valve assembly having a valve, an actuating member operatively coupled to the platform and configured to actuate the valve between an open position and a closed position, and a biasing member disposed between the platform and the housing; and a spray assembly coupled to the valve assembly and including a first fluid dispenser and a second fluid dispenser;

wherein the weight of the user moves the platform so that the actuating member actuates the valve to the open position and the fluid is dispensed through the first fluid dispenser generally upwardly through the platform and through the second fluid dispenser generally horizontally through the openings in the first side section and the second side section of the housing.

10. The apparatus of claim 9 further including a supply of water coupled to the valve and a supply of disinfectant coupled to a mixing valve, wherein the supply of water and the supply of disinfectant being located in the housing.

11. The apparatus of claim 10 further including a volume control valve coupled to the mixing valve and configured to adjust the volume of water supplied to the spray assembly.

12. The apparatus of claim 10 further including a mixing valve adjusting screw coupled to the mixing valve and configured to adjust the volume of disinfectant dispensed.

13. The apparatus of claim 9 wherein the biasing member includes at least one spring configured to partially support the platform.

14. The apparatus of claim 9 wherein the spray assembly includes a spray ring located under the grate.

15. The apparatus of claim 9 further including a pair of upwardly extending grab bars connected to the housing.

16. The apparatus of claim 9 further including a tray located under the platform and configured to collect the fluid.

17. The apparatus of claim 9 wherein the platform is a grate assembly and the force applied to the grate assembly is the user stepping onto the grate assembly.

18. The apparatus of claim 17 wherein the grate assembly is coupled to the housing with a biasing element.

19. The apparatus of claim 18 wherein the biasing element is a coil spring.

20. The apparatus of claim 17 wherein the valve includes an operating lever coupled to the grate assembly so that when a worker steps onto the grate assembly the first valve assembly allows the flow of fluid to the fluid dispensing assembly.

* * * * *